US008147315B2

(12) United States Patent
Chim

(10) Patent No.: US 8,147,315 B2
(45) Date of Patent: Apr. 3, 2012

(54) GAMING APPARATUS WITH PERSISTENT GAME ATTRIBUTES

(75) Inventor: Chi We Chim, Castle Hill (AU)

(73) Assignee: Aristocrat Technologies Australia Ltd (AU)

( * ) Notice: Subject to any disclaimer, the term of this patent is extended or adjusted under 35 U.S.C. 154(b) by 1146 days.

(21) Appl. No.: 11/854,338

(22) Filed: Sep. 12, 2007

(65) Prior Publication Data

US 2008/0076519 A1 Mar. 27, 2008

(30) Foreign Application Priority Data

Sep. 12, 2006 (AU) ..... 2006905030

(51) Int. Cl.
*A63F 9/24* (2006.01)

(52) U.S. Cl. ..... 463/20; 463/16; 463/29

(58) Field of Classification Search ..... 463/20, 463/16, 29

See application file for complete search history.

(56) References Cited

U.S. PATENT DOCUMENTS 5,679,077 A * 10/1997 Pocock et al. ..... 463/19
7,094,154 B2 8/2006 Kellerman et al.
2004/0092315 A1* 5/2004 Boyd et al. ..... 463/42
2004/0143496 A1* 7/2004 Saenz ..... 705/14
2004/0176162 A1* 9/2004 Rothschild ..... 463/29
2006/0080175 A1* 4/2006 Rowe et al. ..... 705/14
2007/0123332 A1* 5/2007 Hishinuma et al. ..... 463/16
2008/0096650 A1* 4/2008 Baerlocher ..... 463/30
2008/0182662 A1* 7/2008 Yoshizawa ..... 463/31
2010/0029381 A1* 2/2010 Vancura ..... 463/30

FOREIGN PATENT DOCUMENTS

WO WO 2006/004931 1/2006
WO WO 2006/004932 1/2006

OTHER PUBLICATIONS

Examiner's first report corresponding to Australian Patent Application No. 2007216754, dated Apr. 29, 2009.

* cited by examiner

*Primary Examiner* — Pierre E Elisca
(74) *Attorney, Agent, or Firm* — McAndrews, Held & Malloy, Ltd.

(57) ABSTRACT

A method is described of providing a game for use with a gaming machine that is arranged to select symbols, present the selected symbols on a display and award an award if a winning outcome occurs. The method comprises receiving identification data for a player and displaying representations of game play of the game, wherein at least one character is depicted as one or more graphic objects. At least one attribute of the character may be amended if a triggering event occurs during game play. The amended attribute may be stored for retrieval in a subsequent game session by the player, wherein the stored amended attribute is associated with the identification data for the player.

23 Claims, 7 Drawing Sheets

GAMING APPARATUS WITH PERSISTENT GAME ATTRIBUTES

CROSS REFERENCE TO RELATED APPLICATIONS

This application claims priority to Australian Patent Application No. AU2006905030, having an international filing date of Sep. 12, 2006, which is hereby incorporated by reference herein in its entirety.

FIELD OF THE INVENTION

The present invention relates generally to gaming apparatus and methods of gaming.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought-after variety, while still developing games that comply with the relevant regulations in the jurisdiction of the gaming venue operator. Suppliers of gaming devices therefore are faced with restrictions on the types of games and gaming apparatus that are allowable, both in terms of the prevailing regulations and in terms of providing a return on investment to the gaming venue operators.

SUMMARY OF THE INVENTION

According to one aspect of the invention there is provided a method of providing a game for use with a gaming machine that is arranged to select symbols, present the selected symbols on a display and award an award if a winning outcome occurs, the method comprising:

receiving identification data for a player;

displaying representations of game play of the game, wherein at least one character is depicted as one or more graphic objects;

amending at least one attribute of the at least one character if a triggering event occurs during game play; and storing at least one amended attribute of the at least one character for retrieval in a subsequent game session by the player, wherein the stored at least one amended attribute is associated with the identification data for the player.

The amended attribute may change at least one visual aspect of the character.

In certain embodiments, the player places a wager to play the game and said amending step amends at least one attribute that affects an average return to player of the game.

The at least one character may be an avatar associated with the player and in one embodiment the method comprises providing a game scenario for the avatar.

The amending step may comprise amending at least one attribute that determines a skill of the avatar within the game scenario.

The skill of the avatar may affect an average return to player of the game.

In one arrangement the method comprises setting game parameters defining a likelihood of the predefined game outcome occurring, the game parameters depending on at least one of the attributes of the character.

In one arrangement the game is played by a single player. Alternatively the game is played by a team of players. The method may comprise offering a player a choice of playing the game alone or as a member of a team.

For a team, the game parameters may be set depending on attributes of avatars associated respectively with a plurality of team members.

For a team, the method may comprise determining a weighting factor for each of the players in the team.

If an award is awarded to the team, the method may comprise dividing the award between the players in the team dependent on the weighting factors.

In one arrangement said amending step comprises offering the player a choice of attributes to amend.

In certain embodiments, the method comprises retrieving attributes of the at least one character associated with the identification data of the player.

According to a further aspect of the invention there is provided a method of providing a game in which at least one random event is displayed and an award is awarded if the random event corresponds to a winning game outcome, the method comprising receiving identification data for a player;

retrieving, dependent on the received identification data, at least one attribute of a character depicted as one or more graphic objects during game play; and displaying representations of game play of the game, the representations comprising depiction of the character dependent on the at least one retrieved attribute.

According to a further aspect of the invention there is provided a gaming machine that provides a game in which a plurality of symbols are selected and presented on a display and an award is awarded if a winning outcome occurs, the gaming machine comprising an electronic processing system that is arranged to maintain an avatar across a plurality of discrete player sessions of the game.

In certain embodiments, the electronic processing system is further arranged to allow a player to define at least one visual aspect of the avatar.

According to one aspect of the invention there is provided a gaming apparatus operable to provide a game in which at least one random event is displayed and, if the random event corresponds to a winning game outcome, the gaming apparatus awards an award, the gaming apparatus comprising:

a display for displaying representations of game play of the game, wherein at least one character is depicted as one or more graphic objects;

data storage storing identification data for at least one player and one or more attributes defining the at least one character; and a game controller in communication with said display and said data storage, said game controller operable to:

receive identification data for a player;

cause the display of representations of game play of the game;

amend at least one attribute of the at least one character if a triggering event occurs during game play; and store at least one amended attribute of the at least one character for retrieval from said data storage in a subsequent game session by the player, wherein the stored at least one amended attribute is associated with the identification data for the player.

According to a further aspect of the invention there is provided a gaming apparatus for providing a game in which at least one random event is displayed and an award is awarded if the random event corresponds to a winning game outcome, the gaming apparatus comprising:

means for receiving identification data for a player;

means for displaying representations of game play of the game, wherein at least one character is depicted as one or more graphic objects;

means for amending at least one attribute of the at least one character if a triggering event occurs during game play; and means for storing at least one amended attribute of the at least one character for retrieval in a subsequent game session by the player, wherein the stored at least one amended attribute is associated with the identification data for the player.

According to a further aspect of the invention there is provided a computer program product comprising machine-readable program code recorded on a machine-readable medium, for controlling the operation of a data processing apparatus on which the program code executes to perform a method of providing a game in which at least one random event is displayed and an award is awarded if the random event corresponds to a winning game outcome, the method comprising:

receiving identification data for a player;

displaying representations of game play of the game, wherein at least one character is depicted as one or more graphic objects;

amending at least one attribute of the at least one character if a triggering event occurs during game play; and storing at least one amended attribute of the at least one character for retrieval in a subsequent game session by the player, wherein the stored at least one amended attribute is associated with the identification data for the player.

According to a further aspect of the invention there is provided a computer program comprising machine-readable program code for controlling the operation of a data processing apparatus on which the program code executes to perform a method of providing a game in which at least one random event is displayed and an award is awarded if the random event corresponds to a winning game outcome, the method comprising:

receiving identification data for a player;

displaying representations of game play of the game, wherein at least one character is depicted as one or more graphic objects;

amending at least one attribute of the at least one character if a triggering event occurs during game play; and storing at least one amended attribute of the at least one character for retrieval in a subsequent game session by the player, wherein the stored at least one amended attribute is associated with the identification data for the player.

BRIEF DESCRIPTION OF THE DRAWINGS

Embodiments of the invention are described below with reference to the Figures, in which.

DETAILED DESCRIPTION

Operating Environment

Figure 1:
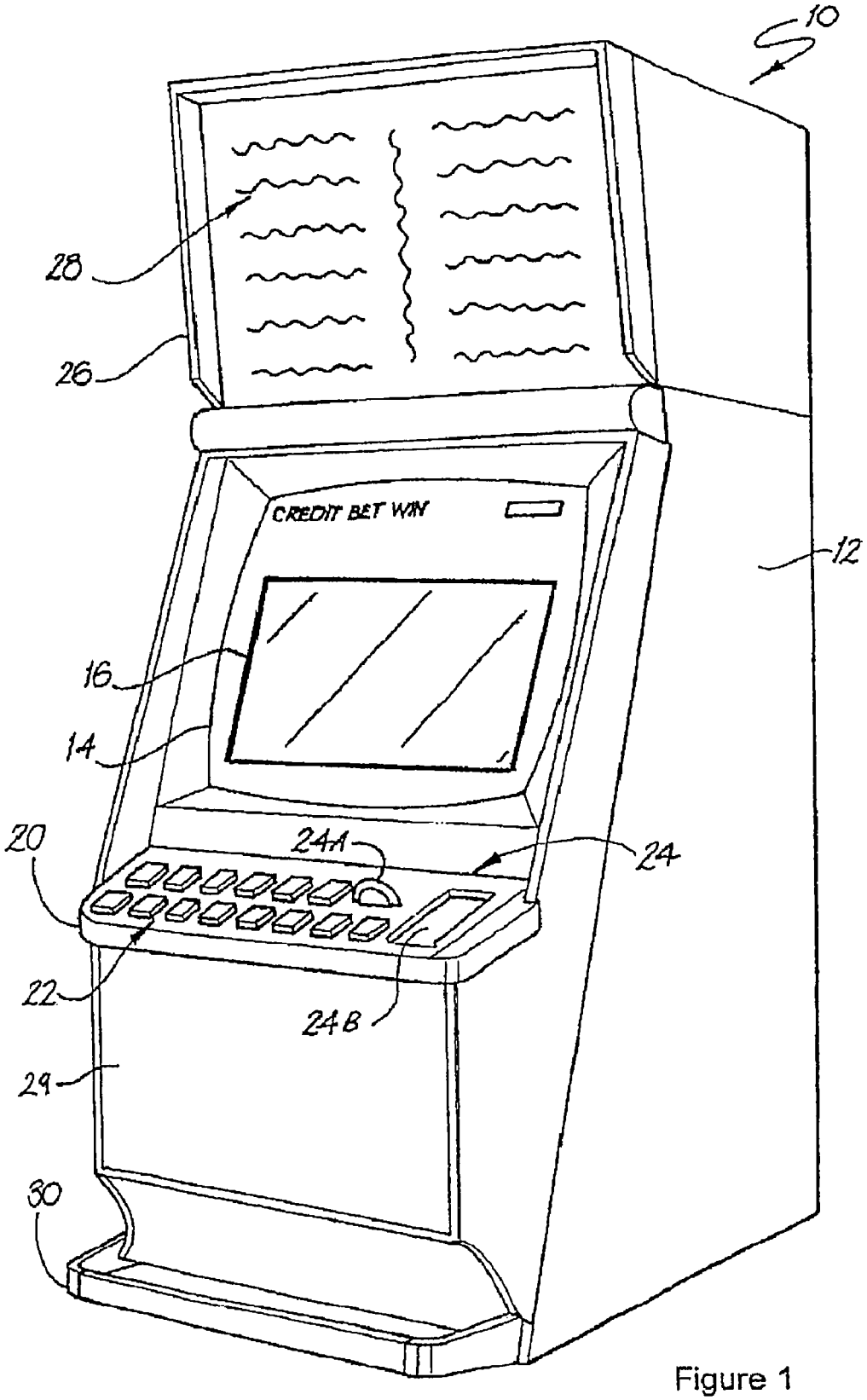
FIG. 1 shows a view of a gaming machine suitable for implementing certain embodiments of the present invention.

In FIG. 1 of the accompanying drawings, one example of a gaming machine suitable for implementing certain embodiments of the present invention is generally referenced by arrow 10.

The gaming machine 10 includes a console 12 having a display 14 on which is displayed representations of a game 16 that can be played by a player. A mid-trim 20 of the gaming machine 10 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, for example a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

Figure 2:
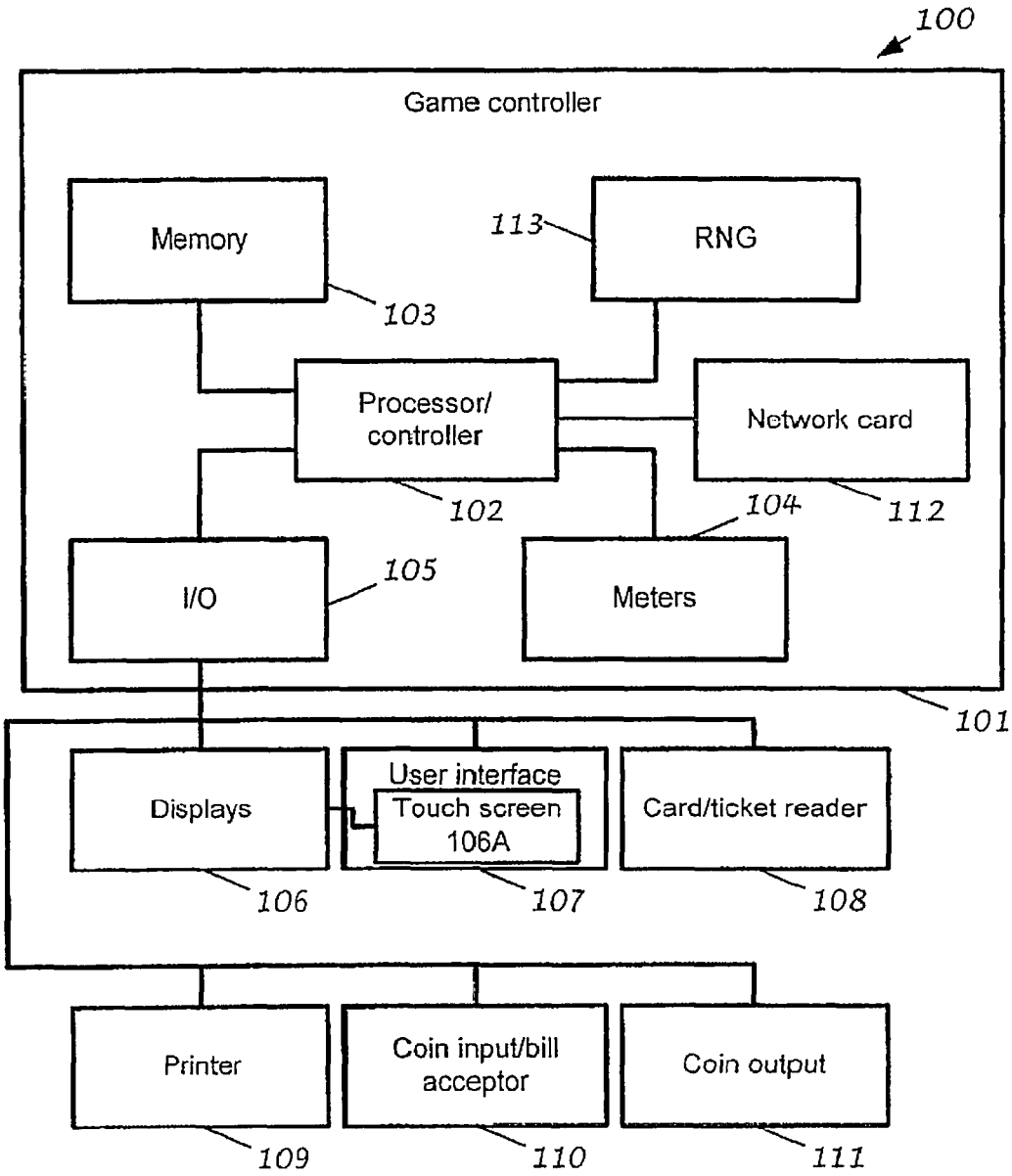
FIG. 2 shows a schematic block diagram of gaming apparatus suitable for implementing certain embodiments of the present invention.

FIG. 2 shows a block diagram of a gaming apparatus, generally referenced by arrow 100, suitable for implementing certain embodiments of the present invention. The gaming apparatus 100 may, for example, operate as a standalone gaming machine of the type shown in FIG. 1. However, the gaming apparatus 100 may alternatively operate as a networked gaming machine, communicating with other network devices, such as one or more servers or other gaming machines. The gaming apparatus 100 may also have distributed hardware and software components that communicate with each other directly or through a network. Accordingly, different reference numerals have been used in FIG. 2 and FIG. 1 for components that may be equivalent.

The gaming apparatus 100 includes a game controller 101, which in the illustrated example includes a microprocessor, microcontroller, programmable logic device or other computational device 102. Instructions and data to control operation of the computational device 102 are stored in a memory 103, which is in data communication with the computational device 102. Typically, the gaming apparatus 100 includes both volatile and non-volatile memory and more than one of each type of memory, with such memories being collectively represented by the memory 103. The instructions to cause the game controller 101 to implement the present invention will be stored in the memory 103.

The gaming apparatus may include meters 104 for the purposes of regulatory compliance and may also include an input/output (I/O) interface 105 for communicating with the peripheral devices of the gaming apparatus 100. The input/output interface 105 and/or the peripheral devices may be intelligent devices with their own memory for instructions and data.

In the example shown in FIG. 2, the peripheral devices that communicate with the controller are one or more displays 106, user interfaces 107, a card and/or ticket reader 108, a printer 109, a bill acceptor and/or coin input mechanism 110 and a coin output mechanism 111. One or more of the displays 106 may include a touch screen 106A, forming part of the user interface 107. Additional devices may be included as part of the gaming apparatus 100. Devices may be omitted as required for the specific implementation.

In addition, the gaming apparatus 100 may include a communications interface, for example a network card 112. The network card, may for example, send status information, accounting information or other information to a central controller, server or database and receive data or commands from a the central controller, server or database. The game controller 101 may also include a random number generator (RNG) 113, which generates a series of random numbers that determine the outcome of a series of random game events played as part of a game on the gaming apparatus 100. The random number generator may be implemented as software or as a hardware module. As explained in more detail in relation to FIG. 4, the computational device 102 may include two or more controllers or processors, which may be local or remote from each other and the displays 106.

Figure 3:
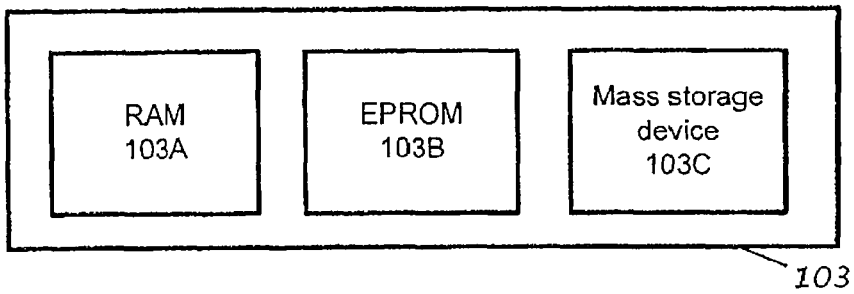
FIG. 3 shows a schematic block diagram of components of the memory of the gaming apparatus represented in FIG. 2.

FIG. 3 shows an exemplary block diagram of the main components of the memory 103. The RAM 103A typically temporarily holds program files for execution by the computational controller 102 and related data. The EPROM 103B may be a boot ROM device and/or may contain some system or game related code. The mass storage device 103C is typically used to store game programs, the integrity of which may be verified and/or authenticated by the computational controller 102 using protected code from the EPROM 103B or elsewhere.

Figure 4:
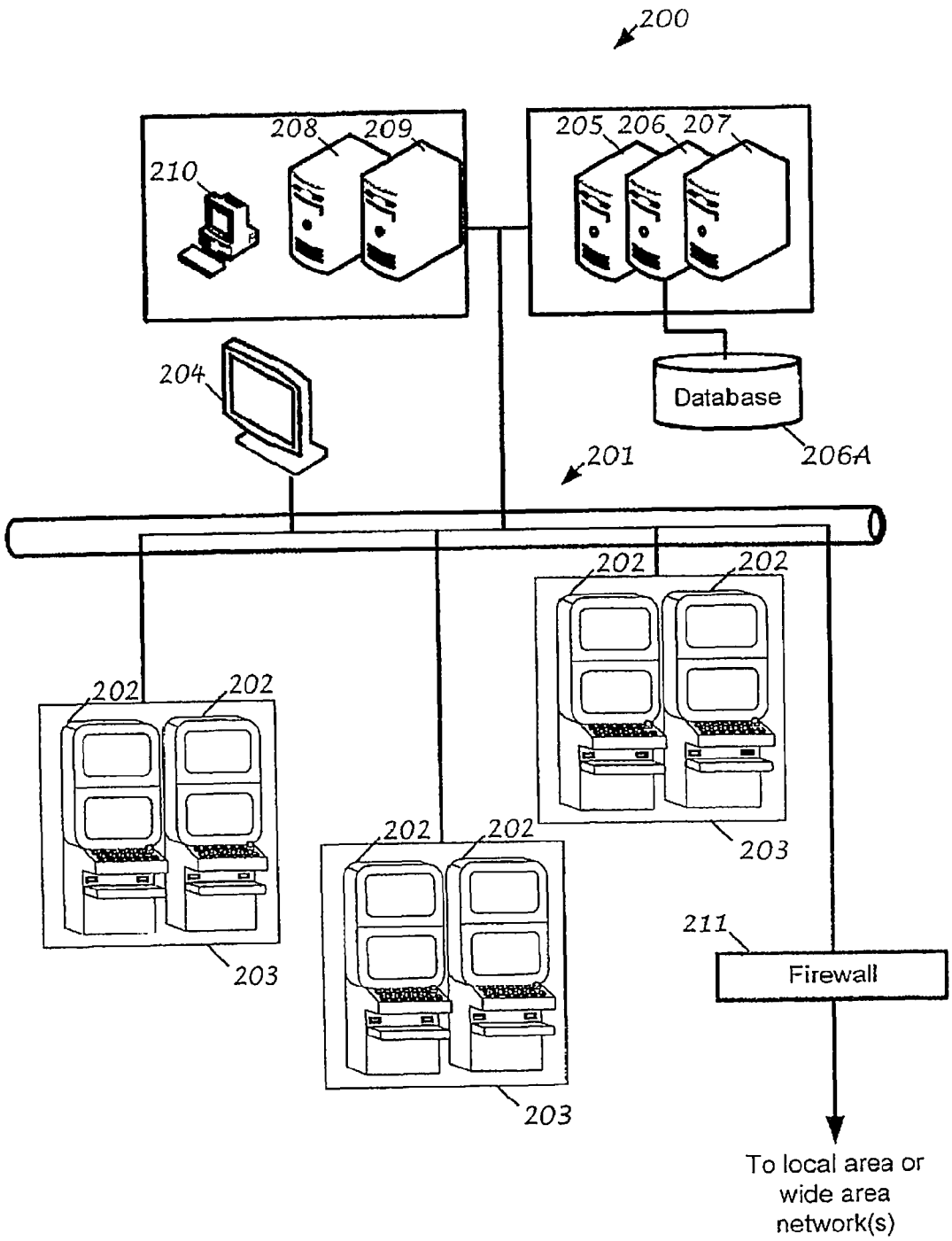
FIG. 4 shows schematically a network gaming system suitable for implementing certain embodiments of the present invention.

FIG. 4 shows a gaming system 200. The gaming system 200 includes a network 201, which for example may be an Ethernet network. Gaming devices 202, shown arranged in three banks 203 of two gaming devices 202 in FIG. 4, are connected to the network 201. The gaming devices 202 may be gaming machines 10 as shown in FIG. 1 or form part or all of another gaming apparatus 100. Single gaming devices 202 and banks 203 containing three or more gaming devices 202 may also be connected to the network 201.

One or more displays 204 may also be connected to the network 201. The displays 204 may, for example, be associated with a bank 203 of gaming devices. The displays 204 may be used to display representations associated with game play on the gaming devices 202, and/or used to display other representations, for example promotional or informational material.

Servers may also be connected to the network 201. For example, a game server 205 may generate game outcomes for games played on the gaming devices 202. A database management server 206 may manage the storage of game programs and associated data for downloading or access by the gaming devices 202 in a database 206A. A jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 210 is provided to allow an administrator to run the network 201 and the devices connected to the network 201.

The gaming system 200 may communicate through a firewall 211 with other gaming systems or other local networks, for example a corporate network, and/or a wide area network such as the Internet.

Avatars

In one or more games that may be played on the gaming machine 10, gaming apparatus 100 or gaming system 200, a player is represented within a game scenario by an avatar. The avatar is typically an animated character depicted as one or more graphic objects, for example on displays 106. The player may control actions of his or her avatar within the game scenario, for example using the user interface 107.

It will be appreciated that a wide range of user interfaces may be used. For example, the player may press a physical button in the bank of buttons 22 or select a button on a touch screen 106A to cause the avatar to perform an action within the game scenario. The player may also use a joystick (not illustrated). In a further alternative, the gaming apparatus may include a camera that records movements of the player. Software running on the game controller 101 may detect the player's movements and cause the avatar depicted on displays 106 to move in a similar manner.

Different game scenarios may be provided in which the avatar appears. In one example the avatar is a pirate who enters a cave in which treasure is buried. The pirate may be caused to dig, possibly unearthing treasure which results in an award being made to the player. A game scenario may involve the display of graphics objects that provide an environment with which the avatar interacts. Alternatively a game scenario may be the display of the avatar alone, preferably performing an action or series of actions.

The avatar has a range of associated attributes that determine the avatar's appearance and skill at various tasks within game scenarios. For example, the pirate may have a 'strength' attribute that affects the pirate's ability to dig. The pirate may carry a supply of food that diminishes as digging proceeds. Thus, increasing the pirate's food supply may increase the duration of the digging, thereby increasing the chances of unearthing treasure.

Different attributes may enhance or diminish an avatar's skill at different tasks. For example, a game scenario may present tasks for an avatar where 'speed' is an advantage. Other tasks, for example weight-lifting, may depend on a 'strength' attribute. In such a weightlifting game, the heavier the weight lifted by the avatar, the more bonus credits won by the player. Strength may be a liability in tasks that require speed. A player may not know in advance what game scenario will be presented.

The use of avatars may increase a player's interest in a game or series of games. The player may feel a greater involvement in a game where he or she may associate with an avatar and have some input into the events represented on the displays 106. A diversity of graphic stimuli associated with different game scenarios may help sustain the player's interest.

Described herein are arrangements in which at least some avatar characteristics are persistent. Thus, a player may make several visits to a gaming machine 10, gaming apparatus 100 or gaming system 200 and log on to retrieve his or her avatar. Such arrangements may provide an incentive for the player to return to a particular gaming venue, or chain of gaming venues, in order to resume an association with a familiar avatar.

Animated Characters Delivering Player Information

In one or more games that may be played on the gaming machine 10, gaming apparatus 100 or gaming system 200, an animated character may be displayed during a gaming session that supplies information visually and/or audibly. The use of such an animated character is described, for example, in Australian patent 766916 "Player information delivery", filed 26 Nov. 1999, the contents of which are incorporated herein by cross-reference.

The animated character may have four modes of operation:

1) an entertainment mode in which, for example, a character performs comical actions to entertain the game player;
2) an information mode for conveying messages to the player;
3) a help mode in which the animated character offers advice and assistance to the player; and
4) a payment mode in which the animated character acts to award a prize either independently of any game being played in the gaming session, or as a bonus in the current game or a subsequent game. The character may initiate a series of special bonus games.

The animated character is displayed as one or more graphic objects on displays 106. The character may be any graphic symbol, icon or figure. The character may, for example, be a letter of the alphabet, or a cartoon figure of a coin or money-bag.

Described herein are methods in which the character may acquire additional or altered characteristics during the course of a gaming session by a game player. Attributes descriptive of the character are updated, and may affect the visual appearance or behaviour of the character. The updated attributes may affect the payment features associated with the character, for example to increase the likelihood of the player being awarded a prize while the character is displayed. The updated attributes may affect the expected return to player.

In the described arrangements, at least some of the acquired character attributes are persistent between gaming sessions. The persistent attributes are stored, associated with player identification data, and retrieved if the player logs on for a subsequent gaming session.

Data Storage to Provide Persistence

In order to provide persistent characteristics for an avatar or other animated character, information is stored in data storage identifying the player and an associated avatar or character, together with any persistent attributes of the avatar or character.

The information may be stored on a single gaming device such as gaming machine 10 or gaming apparatus 100, for example in memory 103. In such an arrangement the player may only resume use of the avatar or character with acquired persistent attributes if the player returns to the particular machine on which the persistent information is stored.

Alternatively, the information identifying the player and the associated persistent information may be stored remotely from the gaming device used by the player and retrieved as required, for example via the network interface 112. In the gaming system 200 the information may be stored on the database 206A under the control of database management server 206. The stored information may be communicated via the network 201 to a gaming device 202 used by the player. In this way the player may retrieve his or her avatar with persistent attributes from any of the gaming devices 202 communicating via network 201. The network may be a wide area network providing access to the avatar from more than one gaming venue. Furthermore, the information identifying the player and any persistent features of the avatar or character may be stored on a smart card or other portable memory device.

The player may log on to a gaming device 202 by providing an input that identifies the player, preferably uniquely. The input may be a previously-established password or user name, or data stored on a machine-readable card inserted into the card reader 108. Biometric information or other identifying inputs may also be used. Based on the input, information related to the player is retrieved from local memory 103 or remote database 206A. The retrieved information may include characteristics of the player's associated avatar or animated character, including any persistent attributes the avatar or character has accumulated in previous gaming sessions by the player.

The player's identifying input is set up in an initial session, in which the basic characteristics of the avatar may also be established. For example, the player may choose a character and select aspects of the character's appearance. Alternatively, a default avatar or a randomly-selected avatar may be assigned to the player in the initial session.

Figure 5:
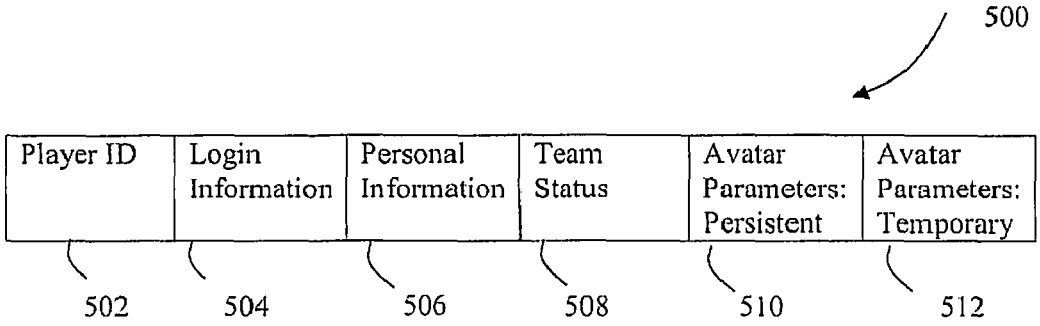
FIG. 5 shows a schematic representation of a data structure storing identification data for a player and associated information defining an avatar representing the player in a game for display on the gaming arrangements of FIG. 1, 2 or 4.

FIG. 5 is a schematic representation of a data structure 500 that may be used to store the player and avatar information in data storage such as memory 103 or database 206A. The data structure 500 may also be stored in a distributed fashion in which some elements are stored locally, for example in memory 103, and other elements are stored remotely, for example in database 206A.

The data structure 500 includes data 502 identifying the player, for example the player's actual name or a user name. This enables the gaming device to interact with the player in a personalised way.

The data structure 500 also includes login information 504 that defines how the player logs in. Information 504 may, for example, be a password or the player's user name. Preferably the login information 504 uniquely identifies the player. To log on, the player may provide the login information by typing on the user interface. Alternatively, the gaming apparatus may accept a physical indicator of the player's identity, such as a smart card, driver's license or senior's card. In this case the apparatus scans the physical indicator to retrieve the required information that identifies the player.

Further personal information 506 about the player may also be stored in data structure 506. For example, the player's postal address or email address may be stored, enabling promotional material to be sent to the player.

As described in more detail below, the avatar-based games may be played by an individual player or by teams of players. The data structure 500 may include data 508 that indicates the team status of the player. Data 508 may include a flag that specifies whether the player is currently part of a team or playing singly. If the player is part of a team, the data 508 includes identifiers of the other team members. Data 508 may also indicate whether the player has previously played as part of a team.

The data structure 500 includes data 510 that identify the persistent characteristics of the avatar associated with the player. Such data 510 determines the basic appearance of the avatar, enabling the avatar to be rendered to displays 106 during a gaming session. Clearly, not all graphic information related to the avatar need be stored in a single data structure. For example, pointers and links to other data structures may be used to reference information required for the avatar to be rendered. The data structure 500 may also include data fields (not shown) that describe persistent characteristics of an animated character that may appear on screen during a gaming session by the player.

During play, the player may win awards that change attributes of the avatar. For example, the avatar may become stronger or faster. Depending on particular game arrangements, such changes to the avatar attributes may be temporary or persistent. For example, an increase in strength may be persistent such that the next time the player logs on the avatar has retained its strength attribute. In contrast, the avatar's food supply may be a temporary attribute that dwindles until no food remains. The data structure 500 may store both persistent parameters 510 and temporary parameters 512.

Similarly, the animated character used for player information delivery may acquire enhanced features during a gaming session. Some or all of the attributes describing the enhanced features may be stored in data structure 500 for retrieval in subsequent gaming sessions by the player. For example, the character may relate to a pick-a-partner feature. The animated character may assist in selecting a partner having a rated compatibility. The animated character may be enhanced by wearing perfume, making the character more attractive within the feature and thus acting to effectively increase the return-to-player (RTP) of the player.

A player may have more than one associated avatar. In this case the data structure 500 may include data about a plurality of avatars for a particular player. When the player logs on, he or she would choose one of the avatars for use in a particular gaming session.

Description of Method for Single Player

Figure 7:
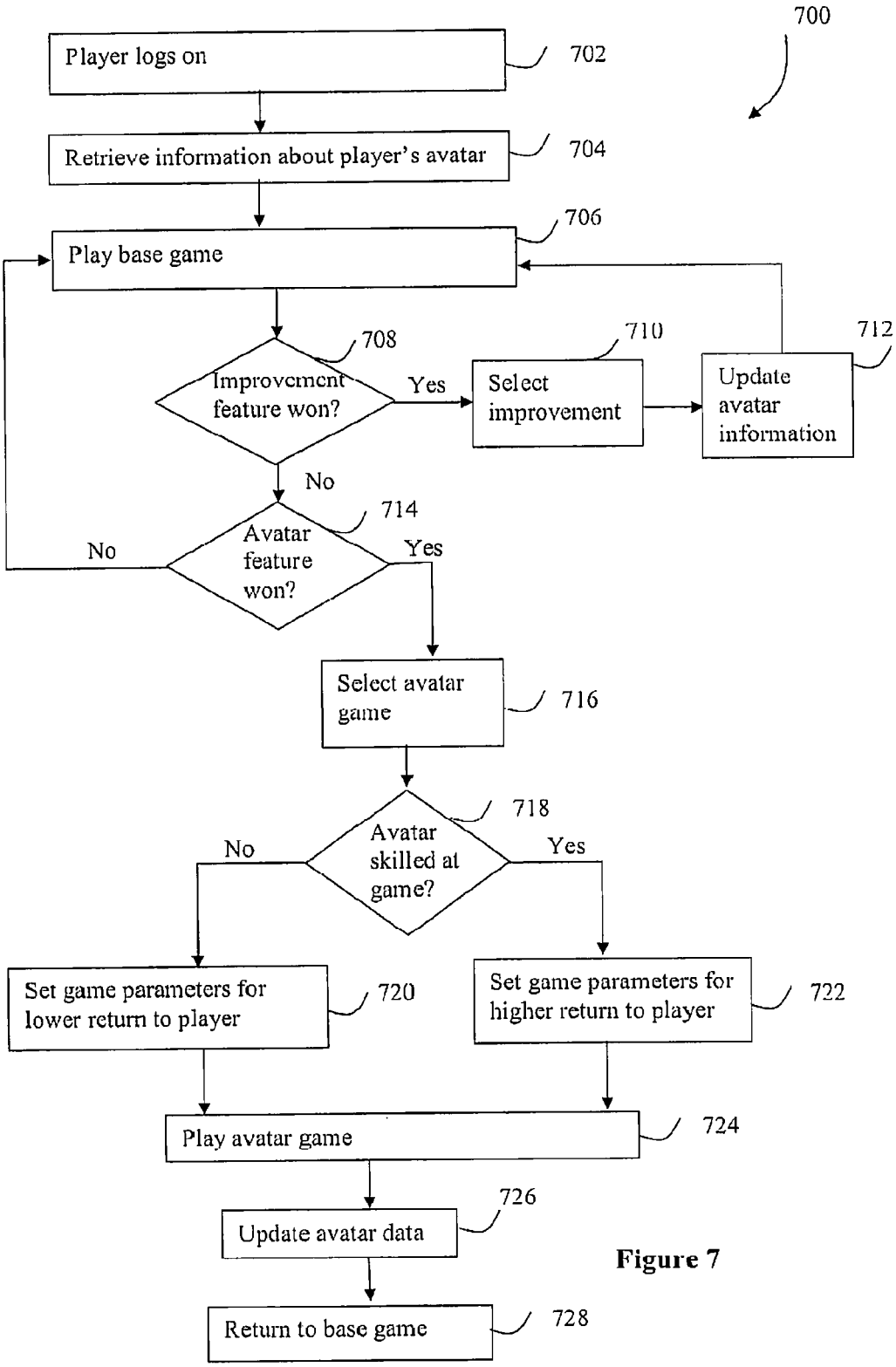
FIG. 7 shows a flow diagram of a method of providing a game in which a player may win improvements in avatar characteristics and play a game in which avatar characteristics affect a likelihood of winning an award in the game.

FIG. 7 shows a flow diagram of a method 700 in which a single player plays a game involving an avatar with persistent attributes. It is assumed that the player has set up basic information in an earlier session and that data related to the player is stored in a data structure 500.

In step 702 the player logs on by entering login information into a gaming device such as gaming machine 10, gaming apparatus 100 or a gaming device 202. In step 704 software, running for example on computational device 102, retrieves data associated with the player from data structure 500. The data may be retrieved from a remote database 206A and/or a local memory 103. The information retrieved defines the persistent attributes of the avatar associated with the player.

In step 706 the player commences a base game on the gaming machine. Typically the player enters a wager, for example using card reader 108 or coin acceptor 110 and initiates a game that is displayed on one or more of the displays 106. In one arrangement the base game is a spinning reel game in which a plurality of spinning reels are spun and come to rest in a randomly-selected state to display an array of symbols. If a winning combination of symbols occurs, an award may be made. Random number generator 113 may be used to determine the final position of each of the reels.

Figure 6:
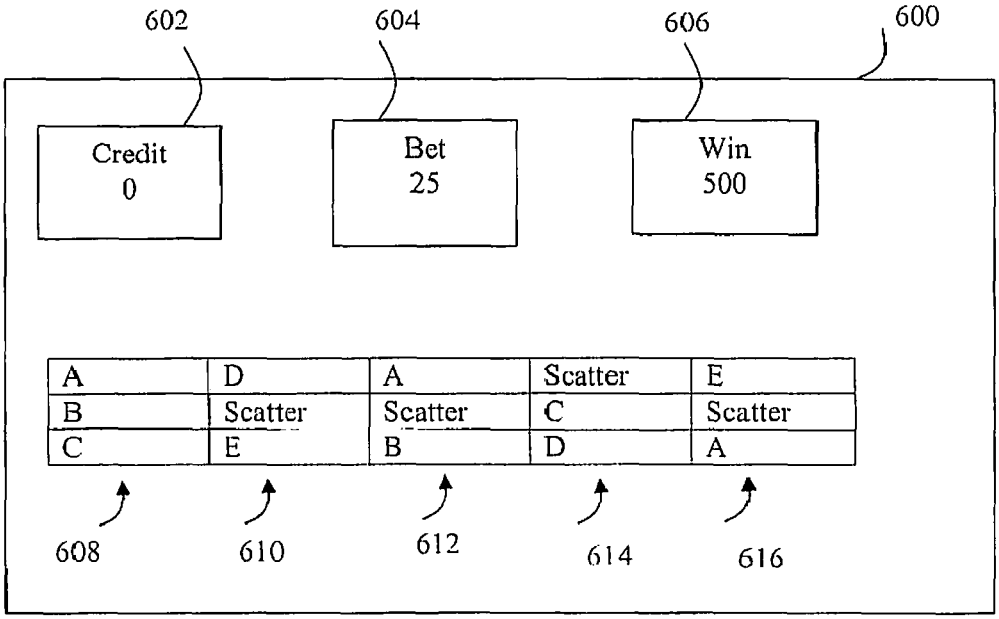
FIG. 6 shows schematically a screenshot of a winning combination in a game.

FIG. 6 shows a screen shot 600 of an example of a possible winning combination in a spinning reel game. There are five spinning reels 608-616 each having three symbols displayed when the reels are at rest. Reel 608 has come to rest displaying symbols represented as A, B and C. In practice the symbols may be drawings of characters or objects. Reel 610 shows symbol D, a scatter symbol and symbol E. Reel 612 shows symbol A, a scatter symbol and symbol B. Reel 614 shows a scatter symbol and symbols C and D. Reel 616 shows symbol E, a scatter symbol and symbol A. Scatter symbols may contribute to winning combinations regardless of the row on which they appear. The occurrence of four scatter symbols on the screen shot 600 is an example of a winning combination. The screen shot 600 also shows at 602 that the player has a credit of 0 units and, at 604, has bet 25 units. At 606 the display shows a win meter that indicates that the player has won 500 credits.

The base game is not limited to spinning reel games. Other games, for example card games or dice games, may also be presented on the gaming device 202.

After each spin of the spinning reels 608-616, software running on the game controller 102 checks, in step 708, whether a triggering combination of symbols has occurred that entitles the player to select an improvement to an avatar attribute. The specified combination may be, for example, a configuration like that shown in screen shot 600, showing 4 scatter symbols. In the example the specified combination results in an award of credits to a win meter and also an ability to select an improvement to an avatar. However, the award could be solely the improvement to an avatar. Other triggering events may also trigger the ability to amend the avatar. Such triggering events could, for example, depend on turnover or a random trigger.

If the triggering combination has occurred (the Yes option of step 708) then in step 710 the display 106 is altered to show one or more options relating to improved attributes for the player's avatar. For example, the player may be offered the choice of improving the avatar's 'strength' attribute or the avatar's 'speed' attribute. The player may select an option using the user interface 107, for example using the touch screen 106A. Amendments to the avatar may involve adding a new attribute, removing an attribute or changing one or more parameters of an attribute.

When the player has made a choice, the avatar information 510 and/or 512 is updated in the data structure 500. Process flow then returns to step 706 and the player continues to play the base game. Alternatively, the choice of the improvement may be made for the player, for example through a random selection from the available improvements.

If the current reel configuration does not entitle the player to improve the avatar characteristics (the No option of step 708), then in step 714 the controlling software checks whether the reel configuration entitles the player to play a feature game involving the avatar. The feature game is won if a specified configuration of symbols is displayed. It will be understood that there are many events that may be predefined as triggering the avatar feature game. The triggering event may be a predefined combination of symbols on the spinning reels. The triggering event may be the occurrence of a randomly selected time within a time period, or may be associated with a specified turnover, either of a single gaming device or a plurality of gaming devices. The triggering event may also be the collection of a certain number of tokens, the collection of a token occurring when a particular event occurs in the game, for example the spinning up of a particular combination. The avatar feature may also be automatically won when the improvement feature is won, so that play of the avatar feature or at least the option to play the avatar feature automatically follows step 712.

If the avatar feature game has not been triggered (the No option of step 714) then process flow returns to step 706 and the player resumes the base game. If the avatar feature has been won, then in step 716 the player may be presented with a range of options concerning the feature game to be played. This gives the player the opportunity to select an option that best matches the skills of the associated avatar. The gaming apparatus may make a recommendation as to which option to choose.

Alternatively, the feature game may be automatically selected in step 716 without giving the player the chance to choose a feature game. In other implementations there may only be a single feature game rather than a choice between different avatar feature games.

Next, in step 718, controlling software running for example on computational device 102 checks whether the player's avatar is skilled at the selected game. For example, if the avatar has a high 'strength' attribute, the avatar may be skilled in a game having a weightlifting scenario.

If the avatar is skilled at the selected game, then in step 722 the controlling software sets game parameters to increase the player's chances of winning in the avatar feature game. For example, a strong pirate may dig up more treasure, or a strong weightlifter may lift heavier weights to reveal a larger prize.

If the avatar lacks skills for the selected game, then in step 720 the controlling software sets the game parameters such that the player has a lower chance of winning in the avatar feature game. Here the meaning of 'lower chance' is relative to the parameters set in step 722. Step 720 may reduce one or more game parameters, or step 720 may leave the game parameters at their current values.

Once the game parameters have been set in step 720 or 722, the software running on computational device 102 plays the avatar game in step 724, and displays the game on displays 106. The displayed game includes representations of the player's avatar. The game is played in accordance with the game scenario for the selected game. The player's chance of winning or the size of the win depends at least to some extent on the game parameters set in steps 720 or 722.

If required, the avatar data is updated in step 726. For example, if the avatar relies on a supply of food, this may diminish in the course of a game.

When the avatar game is complete, process flow may return to the base game in step 728.

In one embodiment, the avatar is a character that provides the player with the chance to win free games. The attributes of the character may determine the average number of free games that may be won. In turn, the average number of free games may change the expected return-to-player (RTP) of the game. For example an avatar having one set of attributes may win on average ten free games, resulting in an overall RTP of about 87% and an avatar having another set of attributes may win on average twenty free games, which may result in an overall RTP of about 89%. In the course of the game the player may win the chance to improve the character attributes, thereby affecting the RTP of the game.

In the example outlined in FIG. 7 the avatar amendment is triggered in a base game and the avatar game is a feature game triggered from the base game. In alternatives, avatar improvements may arise from triggering events in an avatar game.

Description of Method for a Team

Figure 8:
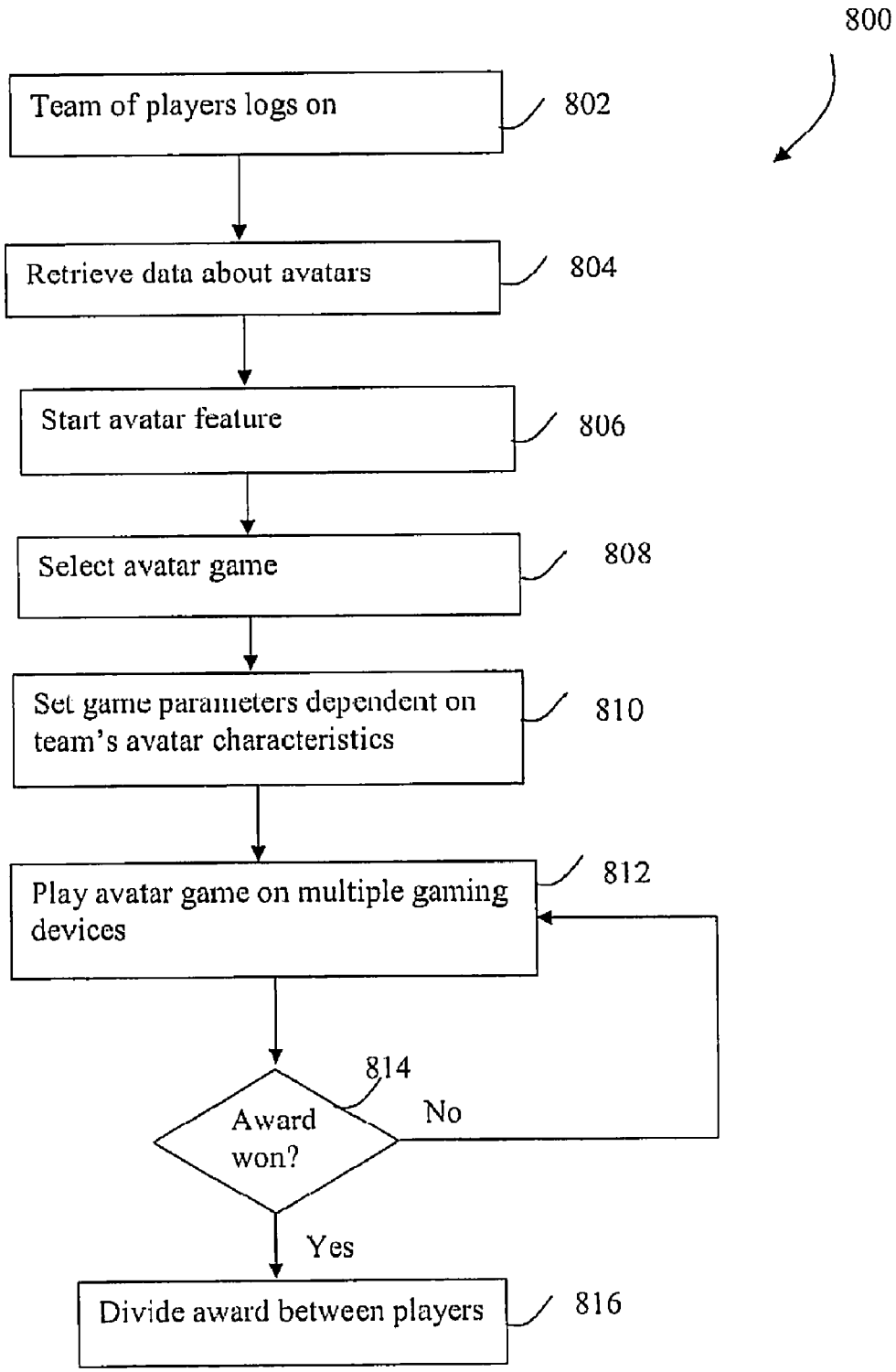
FIG. 8 shows a flow diagram of a method of providing a game in which a team of players is represented by avatars.

The avatar game may also be played by a team of players, as illustrated in the method 800 of FIG. 8.

In step 802 each member of the team identifies him- or herself to the gaming system 200, for example by logging on or by inserting a player identification card. Each player in the team may log on to a different gaming device 202. Software running on the game server 205 may coordinate the activity of the team members.

In the login procedure, players may be asked whether or not they will be playing as part of a team. The question may be displayed on displays 106. If the player elects to play as a team member, input screens are displayed enabling the player to indicate the identity of other team members. Alternatively, the player may indicate that he or she wishes to play as part of a team and the gaming system 200 may form teams as required from groups of players that have indicated that they wish to play as a team.

The team members need not log on simultaneously. For example, if a first player is logged on to a gaming device 202 and a second player later logs on to another gaming device, the respective gaming machines may display messages to the first and second players, alerting them that the other player is logged on. A message may then be displayed, asking whether the players wish to continue playing as a team. There may be an incentive to functioning as a team, such as a greater chance of winning. For example, if there are four players in a team, the game may offer a chance of winning that is approximately four times higher than the chance of winning if a single player is playing, the actual chance of winning being dependent on the attributes of the avatars of the team members. The award is, however, divided between the team members.

In step 804 information about team members who have logged on is retrieved from database 206A by database management server 206. The retrieved data includes the persistent attributes of the avatars representing the team members. The retrieved data also includes team information for logged on players, for example whether the player has previously been part of a team and identifying data of the other team members.

In step 806 the avatar feature is started. There are various ways in which the avatar feature may be triggered. In one arrangement the avatar feature commences directly once the team members are logged on. In this arrangement each player may have to pay an entry fee to play the avatar feature. In another arrangement the team members each play a base game on their respective gaming devices 202 and the avatar feature is triggered by one or more predefined events in the base games. For example, the entire team may enter the avatar feature if a single team member has a specified winning combination in the base game. Alternatively every member of a team may have to achieve the specified winning combination before the avatar feature is played, with the team members that achieve the winning combination first having to wait for other team members to achieve the winning combination. Where the teams are predefined, the gaming devices 202 may display which of the team members has achieved the winning combination and which team members have still to achieve the combination before the team can enter the avatar feature. The required number of players for the avatar feature may be less than the entered team members or may be all of the team members.

Individual team members may be given the opportunity to leave the team and play the feature alone if they choose to and this may automatically occur if a player indicates that he or she wishes to cash out/quit. Where the teams are dynamically formed, the gaming system may check for other players to achieve the specified winning combination and display to the players who have already achieved this combination how many other players are required before the avatar feature can be played as a team. The gaming system 200 may display how many players are currently at gaming devices 202 and which may join the team so that the players that are waiting can imply from this a probable waiting time.

In a further alternative, the team may only enter the avatar feature once the team has accumulated a specified number of tokens in the course of playing the base game. Tokens awarded to a team member are added to a pool of tokens until the required total is reached.

The player may make the selection as to whether they wish to be in a team at the commencement of a player session, following the occurrence of the specified winning event, or both. In addition, where the teams are dynamically formed, either from all players in the gaming system 200 (or a particular subset of the gaming system 200) or from members out of a larger predefined membership, the player may specify what size team they wish to participate in.

In the base game the players may have the option of improving the skills of their avatar, as described above with reference to steps 708, 710 and 712. In the avatar games played by predefined teams, team members may wish to coordinate the skills attributed to their respective avatars. For example, if the avatars have a wide range of skills it may increase the team's chance of winning in a range of game scenarios. Thus, if a team member wins the chance to improve the skills of his or her avatar, the team member may review the current range of skills of the team avatars and opt for a skill where the team's avatars are currently weak. The gaming system 200 may give suggestions to the players as to which attributes are most likely to increase the return of a team and/or which are most likely to increase the return to the player if the player plays alone. Alternatively, the choice may not affect the overall expected return of the team or the player, but may instead alter the volatility of the avatar feature. For example if all team members chose the same attributes and/or each team member had won multiple attributes and selected the same attribute each time, then the award for an avatar feature scenario that complements the selected attributes may be very high, but the rewards for others comparatively low. The range of awards likely to be won in different scenarios may be reduced if the players selected a range of attributes. The gaming system may provide feedback to the players on the effect on the volatility by making particular choices.

In some game scenarios the avatar skills may be complementary. For example, if the team's avatars have a given combination of attributes, the team's overall chances of winning may be increased. One example of such a game scenario is a bank robbery in which the players' avatars try to break into a bank to win a jackpot or bonus game. The avatars may be, for example, a cat burglar, explosives expert, gunman or safe cracker. The individual avatars may acquire improved skills in the course of a gaming session based on turnover or features won. An example of the improved attributes is more ammunition for the gunman. The players may wish to play alone, or they may choose to work as a team to break into the bank. The jackpot or bonus may be shared amongst team members depending on how each member contributed to successfully breaking into the bank.

In step 808 the controlling software selects an avatar game having an associated scenario. The software may select an avatar game at random from a set of avatar games. Alternatively, the team members may be offered a choice of different games. In this case the team members have the added excitement of trying to assess which game is best suited to the attributes of their avatars.

In step 810 the controlling software sets the game parameters dependent on the characteristics of the team's avatars. If at least one of the avatars is skilled at the selected game, then the game parameters may be set to increase the team's chances of winning. The game parameters may be adjusted based on combinations of attributes amongst the avatar characteristics.

In step 812 the avatar game is played by the controlling software. The software may run on a server such as game server 205. Individual modules of the software may also run on the individual gaming devices 202, communicating with one another and/or the game server 206 via network 201. The avatar game is displayed on the displays of the gaming devices 202 used by the team members. The game display includes representations of the avatar or avatars. The team members may have some control over the actions of their respective avatars, using user interface 107 to cause the avatar to perform specified actions.

The game includes at least one randomly-generated event that is displayed on displays 106. The occurrence of certain predefined events causes an award to be made. The chance of at least one of such predefined events occurring is dependent on the game parameters set in step 810. In step 814 the controlling software checks whether one of the predefined events has occurred that causes an award to be won in the avatar game. If no award is made, process flow may return to step 812 to resume play of the avatar game.

If an award has been won (the Yes option of step 814) then in step 816 the controlling software divides the award amongst the team members. The award may be split evenly amongst the players. Alternatively, the award may be divided using relative weights such that a team member having a higher weighting may receive a greater proportion of the award than a team member having a lower weighting. For example, in step 810 a return-to-player (RTP) value may be determined for each team member dependent on the attributes of the team member's avatar. This RTP value may be used as a weight in determining how an award is to be divided between the team members.

After the award has been divided, the avatar game may continue. Alternatively, process flow may return to the base game.

Changing Attributes of Animated Character

Figure 9:
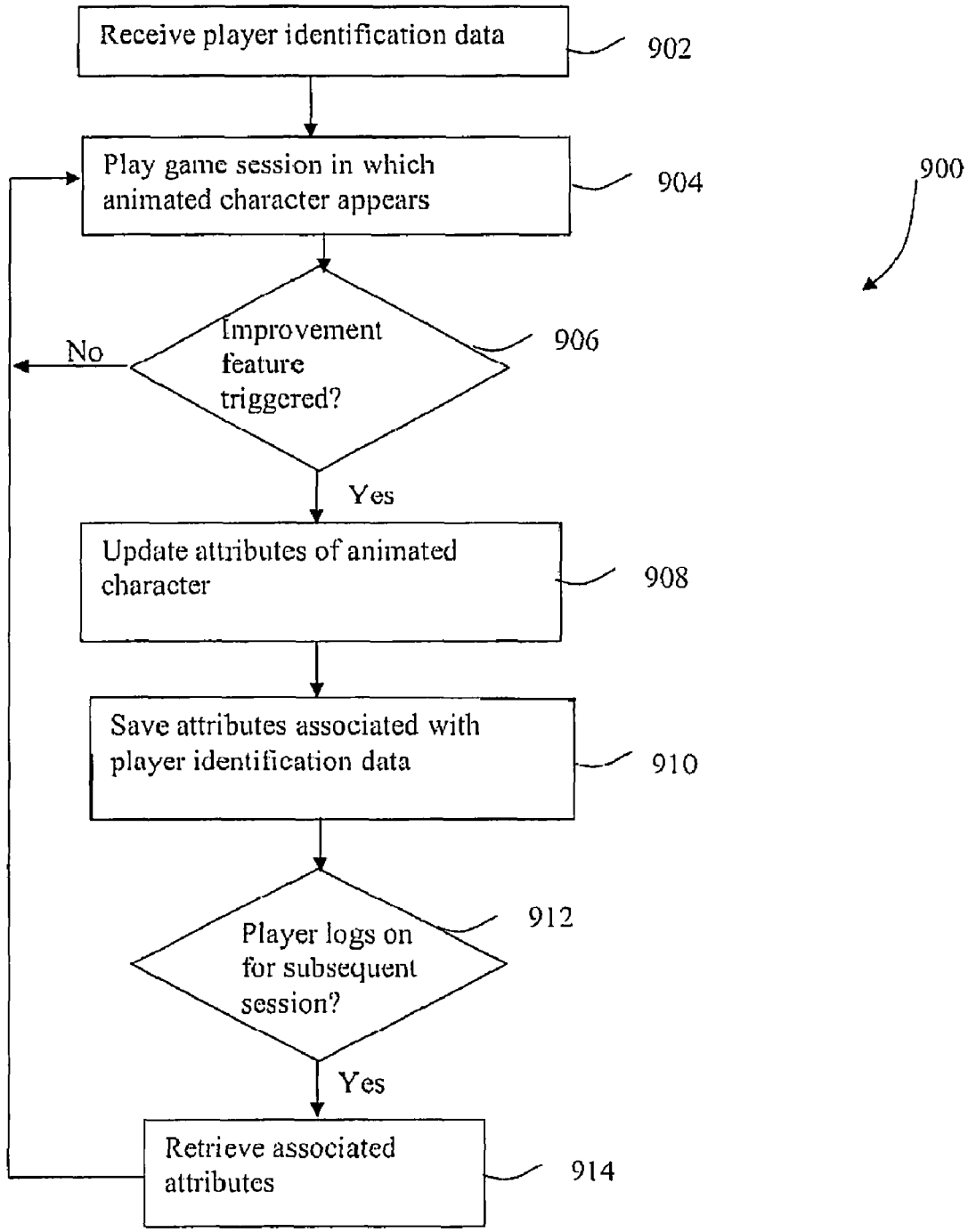
FIG. 9 shows a flow diagram of a method of providing a game session in which an animated character appears, the character having attributes, associated with a game player, that persist between game sessions.

FIG. 9 illustrates a method 900 wherein the persistent attributes of an animated character that appears on the screen during a gaming session may be amended. In the step 902 the plays logs on, as described above. Then (step 904) the player plays a gaming session in which the animated character appears in one or more of the four modes of operation described above.

During the gaming session, the software running on the gaming apparatus checks whether an improvement feature has been triggered. If an improvement feature is triggered, then in step 908 the attributes of the animated character may be updated. In some arrangements the visual characteristics of the animated character may be customised. In other arrangements the enhanced attributes may affect the player's chances of winning an award while the animated character appears on the screen.

The customisation of the animated character may be offered on a turnover basis. For example, the more the player plays the greater the customisation of the animated character. This may correspond to an increased RTP for the player. The turnover may be assessed for a single session or over multiple sessions.

In step 910 some or all of the enhanced attributes of the animated character may be saved in data structure 500 associated with the player's identification data. Then, if the player logs on for a subsequent gaming session (step 912), the attributes of the animated character may be retrieved and used in the subsequent gaming session.

In alternative implementations the amendments made to a character may involve a reduction of an attribute or a decrease in the benefit afforded by the character.

While the foregoing description has been provided by way of example of certain embodiments of the present invention as presently contemplated, which utilise gaming apparatus and machines, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

I claim:

1. A method of facilitating a play of a base game on a gaming machine, the method comprising:

upon logging onto the gaming machine, retrieving identification data about a player, including an avatar associated with the identification data from electronic storage, the avatar having a range of associated attributes that define one or more characteristics of the avatar;

during the play of the base game, if a triggering event occurs, selecting an attribute from the range of associated attributes for change, at least one of the range of associated attributes being a persistent attribute;

associating the attribute with the avatar on the gaming machine so as to alter the one or more characteristics of the avatar; and determining if the selected attribute is the persistent attribute and if so, storing the avatar and the persistent attribute with the identification data about the player in the electronic storage such that the avatar includes changed characteristics that are retrievable from the electronic storage in subsequent game played by the player.

2. A method according to claim 1 wherein the player places a wager to participate in the base game and said persistent attribute affects an average return-to-player.

3. A method according to claim 1 wherein the changed persistent attribute changes at least one visual aspect of the avatar.

4. A method according to claim 1 wherein the method further comprises providing a game scenario for the avatar.

5. A method according to claim 4 wherein said persistent attribute is an attribute that determines a skill of the avatar within the game scenario.

6. A method according to claim 5 wherein the skill of the avatar affects an average return-to-player.

7. A method according to claim 1 wherein the method comprises setting game parameters defining a likelihood of the winning outcome occurring, the game parameters depending on at least one of the attributes of the avatar.

8. A method according to claim 1 wherein the game is played by a single player.

9. A method according to claim 1 wherein the game is played by a team of players.

10. A method according to claim 1 wherein the method comprises offering a player a choice of playing the game alone or as a member of a team.

11. A method according to claim 9 wherein game parameters are set depending on attributes of avatars associated respectively with a plurality of team members.

12. A method according to claim 9 wherein the method comprises determining a weighting factor for each of the players in the team.

13. A method according to claim 12 wherein, if an award is awarded to the team, the method comprises dividing the award between the players in the team dependent on the weighting factors.

14. A method according to claim 1 wherein the method further comprises offering the player a choice of which of the persistent attributes to change.

15. A gaming machine that provides a game in which a plurality of symbols are selected and presented on a display and, if a winning combination occurs, the gaming machine awards an award, the gaming machine comprising:

a display for displaying representations of game play of the game, wherein the displayed representations include an avatar;

data storage storing player identification data and one or more attributes defining the avatar;

a game controller in communication with said display and said data storage, said game controller operable to:

receive player identification data for a player;

cause the display of the displayed representations of game play of the game;

amend at least one attribute of the avatar if a triggering event occurs during game play; and store at least one amended attribute of the avatar for retrieval from said data storage in a subsequent game session by the player, wherein the stored at least one amended attribute is associated with the player identification data for the player.

16. A gaming apparatus that provides a game in which a plurality of symbols are selected and presented on a display and, if a winning combination occurs, the gaming machine awards an award, the gaming apparatus comprising:

means for receiving player identification data for a player from an electronic database;

means for displaying representations of game play of the game;

means for including an avatar respectively associated with the player identification data while said means for displaying operates to display representations of the game play of the game;

means for changing at least one persistent attribute of the avatar if a triggering event occurs during game play;

means for storing the at least one changed persistent attribute along with the player identification data for the player in an electronic database; and means for retrieving the at least one changed persistent attribute of the avatar in a subsequent game session by the player in response to receiving the player identification data at the means for receiving.

17. A non-transitory computer program product comprising machine-readable program code recorded on a machine-readable medium that, when executed by a computer, controls operation of a data processing apparatus on which the program code executes to perform a method of providing a game for use with a gaming machine that is arranged to select symbols, present the selected symbols on a display and award an award if a winning outcome occurs, the method comprising:

receiving player identification data for a player;

accessing an electronic record corresponding to the player identification data to retrieve avatar information, including a persistent avatar for use in game play by the player at the gaming machine;

allowing the player to play a game at the gaming machine;

changing at least one persistent attribute of the avatar if a triggering event occurs during game play; and storing the at least one changed persistent attribute of the avatar for retrieval in a subsequent game by the player, wherein the stored at least one changed persistent attribute is associated with the identification data for the player.

18. A method of providing a game for use with a gaming machine comprising:

receiving player identification data for a player at the gaming machine;

accessing an electronic record corresponding to the player identification data to retrieve avatar information, including avatar attributes, for use in game play by the player at the gaming machine;

allowing the player to play a game at the gaming machine using the selected symbols;

changing at least one persistent attribute of the avatar if a predetermined condition occurs during game play of the game; and storing the changed persistent attribute of the avatar in the electronic record corresponding to the player identification data for retrieval in subsequent game play by the player.

19. A method according to claim 18, wherein the player places a wager to participate in the game and the changed persistent attribute affects an average return-to-player.

20. A method according to claim 18, wherein the changed persistent attribute affects at least one visual aspect of the avatar.

21. A method according to claim 18, further comprising providing a game scenario for the avatar.

22. A method according to claim 21, wherein the changed persistent attribute that affects a skill of the avatar within the game scenario.

23. A method according to claim 22, wherein the skill of the avatar affects an average return-to-player.

* * * * *